US006588387B2

(12) United States Patent
Cecur

(10) Patent No.: US 6,588,387 B2
(45) Date of Patent: Jul. 8, 2003

(54) ROCKER ARM DEVICE FOR SIMULTANEOUS CONTROL OF VALVE LIFT AND RELATIVE TIMING IN A COMBUSTION ENGINE

(75) Inventor: Majo Cecur, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 143 days.

(21) Appl. No.: 09/841,572

(22) Filed: Apr. 24, 2001

(65) Prior Publication Data

US 2001/0023672 A1 Sep. 27, 2001

Related U.S. Application Data

(63) Continuation-in-part of application No. 09/420,035, filed on Oct. 18, 1999, now abandoned.

(30) Foreign Application Priority Data

Oct. 20, 1998 (IT) ..... MI98A2244

(51) Int. Cl.[7] ..... F01L 1/34

(52) U.S. Cl. ..... 123/90.46; 123/90.39; 123/90.16

(58) Field of Search ..... 123/90.16, 90.17, 123/90.39, 90.41, 90.42, 90.46

(56) References Cited

U.S. PATENT DOCUMENTS 4,438,735 A * 3/1984 Burandt ..... 123/90.16
4,516,542 A * 5/1985 Aoyoma et al. ..... 123/90.16
5,572,962 A * 11/1996 Riley ..... 123/90.16
5,577,469 A 11/1996 Muller et al. ..... 123/90.16

FOREIGN PATENT DOCUMENTS

JP 359126011 A * 7/1984 ..... 123/90.16

* cited by examiner

*Primary Examiner*—Thomas Denion
*Assistant Examiner*—Jaime Corrigan
(74) *Attorney, Agent, or Firm*—L. J. Kasper

(57) ABSTRACT

A valve control system including a valve actuating camshaft (A), having a high lift cam (B) and a low lift cam (C), and an outer rocker arm (2) engaging the high lift cam, and an inner rocker arm (3) engaging the low lift cam. The ends of the rocker arms adjacent the engine poppet valve (V) are fixed to each other by a connector pin (37). The system includes a latching mechanism disposed at the ends of the rocker arms opposite the connector pin (37). Latching of the rocker arms is accomplished by a compound pin (8) moved between latched (FIG. 14A) and unlatched (FIG. 14B) conditions in response to movement of an actuator (9). The system also includes a rocker ratio varying device, such that, during operation in the low lift mode, the lift can be gradually increased, and gradually phase-shifted, as the engine speed increases.

12 Claims, 6 Drawing Sheets

ROCKER ARM DEVICE FOR SIMULTANEOUS CONTROL OF VALVE LIFT AND RELATIVE TIMING IN A COMBUSTION ENGINE

CROSS-REFERENCE TO RELATED APPLICATIONS

This application is a continuation-in-part (CIP) of co-pending application U.S. Ser. No. 09/420,035, filed Oct. 18, 1999, in the name of Majo Cecur for a "Rocker Arm Device For Simultaneous Control Of Valve Lift And Relative Timing In A Combustion Engine", which application claimed priority, under 35 U.S.C. 119, of earlier-filed Italian Application MI98A002244, filed Oct. 20, 1998.

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention concerns a rocker arm device suitable for optimizing the functioning of internal combustion engines by controlling the opening and the timing of the cylinder valves according to the engine load and its speed.

For this purpose, it is already known how to use compound rocker arms consisting of two elements as specified in the Italian patent application No. MI97A002067 filed Sep. 11, 1997 in the name of Majo Cecur, assigned to the assignee of the present invention, and incorporated herein by reference. The first element consists of a rocking body, acting as a third-order lever, hinged at one end to an hydraulic lash adjuster, while the other end controls, by a shoe, the valve stem.

The second element comprises a lever, at one end of which is pivoted a roller, which receives the thrust of the cam of the distributing shaft (camshaft), while the opposite end of the lever terminates in an eyelet and is hinged to a pin which can turn within a pivot seat fashioned in said eyelet. The pin is torsionally linked to an eccentric support shaft, the rotation of the shaft being able to shift lengthwise the free end of the lever bearing the roller, so as to vary the position of incidence of the end of the lever itself by influencing the length of the arm of the body of the first element and, therefore, the valve lift and, in part, the timing of the latter. Such an arrangement is referred to as a VRRS (variable ratio rocker system).

With the known device, however, changes in the timing are accomplished only as a result of the particular geometrical shape selected for the cam.

BRIEF SUMMARY OF THE INVENTION

The purpose of the invention is to improve the performance of the known device, enabling a subsequent and independent variation of the timing, along with a regulation of the valve lift.

In the device according to the invention, a pair of rocker arms is placed one within the other and is able to oscillate jointly or independently, and influence in a controllable manner the travel of the shoe associated with the engine poppet valve, thus controlling the valve lift.

The two rocker arms are linked together at one end by means of a common transverse pin, acting as a shoe on the head of the poppet valve, while at the other end the rocker arms are traversed by a compound pin controlled by an hydraulic or electrical actuator which can move transverse to the rocker arms, between two positions, enabling the coaxial and simultaneous oscillation of the two rocker arms in unison in one condition, or the independent oscillation of the rocker arms in the other condition.

For each rocker arm, the distributing shaft (camshaft) is provided with a cam arrangement, specifically, a central cam, acting on the inner rocker arm, which has less eccentricity than the eccentricity of a pair of identical cams, mounted at the sides of said central cam and acting on cheeks or lateral plates of the outer rocker arm to accomplish a larger valve opening and a longer advance.

The thrust of the central cam is transmitted to a needle roller, mounted at the end of an L-shaped lever, the fulcrum of which can be displaced lengthwise with respect to the axis of the rocker arms by means of an eccentric rotating pin. The pin rotates relative to the end of an auxiliary arm which, at the other end, accommodates the seat for the axis of oscillation of the pair of rocker arms.

Through the above mentioned auxiliary arm, which rests against a tappet, one can indirectly guarantee the contact of the inner rocker arm with the roller, the L-shaped lever, and the central cam of the distributing shaft, while the contact of the outer rocker arm with the two outer cams is obtained by means of an auxiliary elastic element connected between the L-shaped lever and the shoe.

BRIEF DESCRIPTION OF THE DRAWINGS

The invention will be better understood through the following description, making reference to the enclosed drawings, on which.

DETAILED DESCRIPTION OF THE PREFERRED EMBODIMENT

Figure 1:
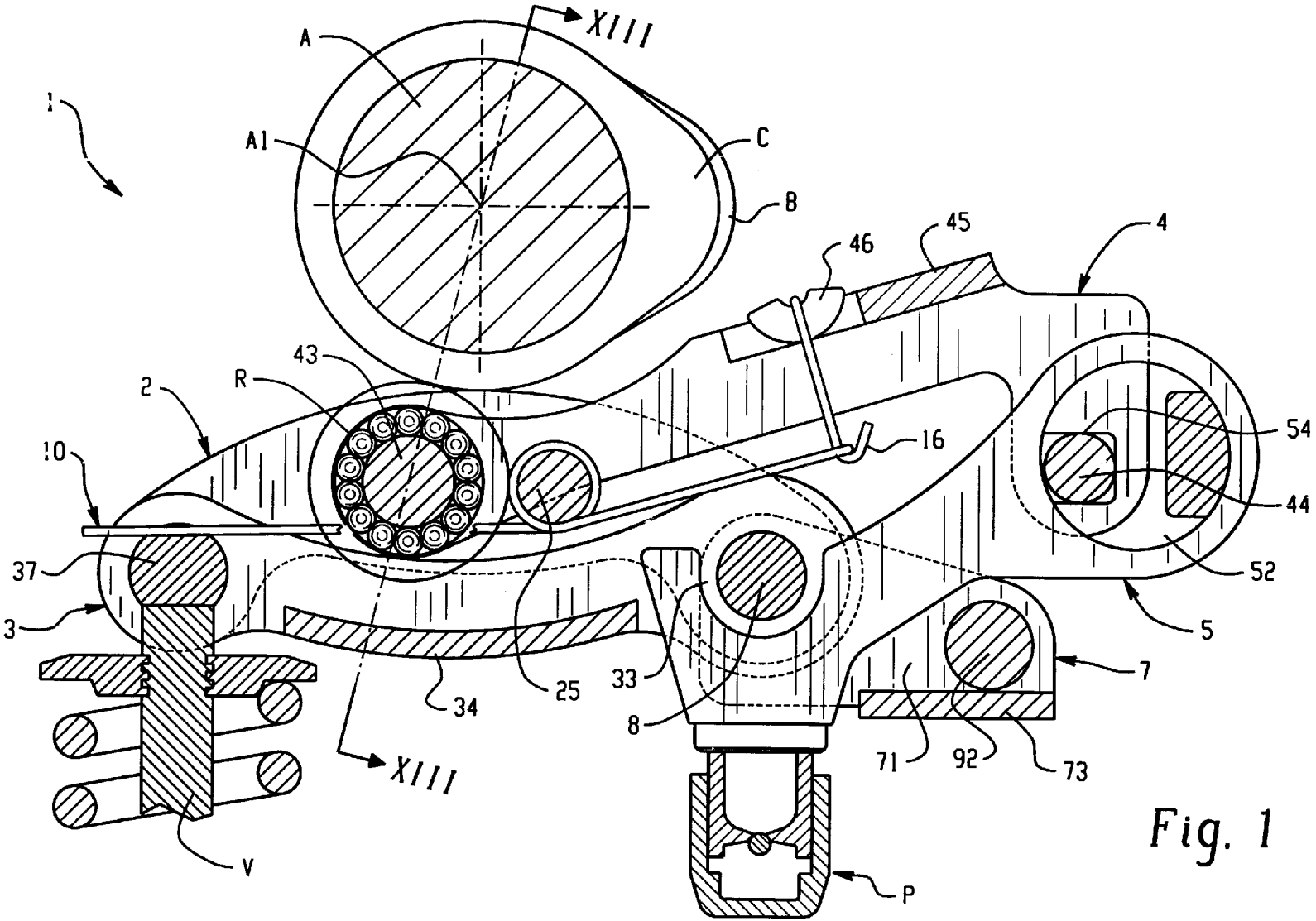
FIG. 1 represents an overall view of the device, in lateral elevated view.

Referring now to the drawings, which are not intended to limit the invention, FIG. 1 illustrates a valve control system, made in accordance with the present invention, for use in controlling the engine poppet valves of an internal combustion engine. The valve control system generally includes an outer rocker arm 2, an inner rocker arm 3, an L-shaped lever 4, and an auxiliary element (or auxiliary arm) 5. The system further includes a fork element 7 (also call a shifting fork), a compound pin 8, an actuator 9 (see FIG. 14A), an elastic element 10, and a connector pin (or common shaft) 37. Each of the above-mentioned items will be described in greater detail hereinafter.

Figure 3A:
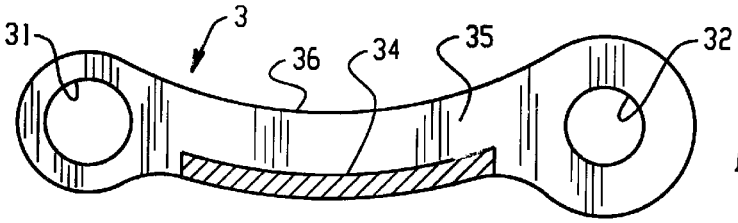
FIGS. 3A and 3B show the inner rocker arm, in elevated and plan view, respectively.
Figure 3B:
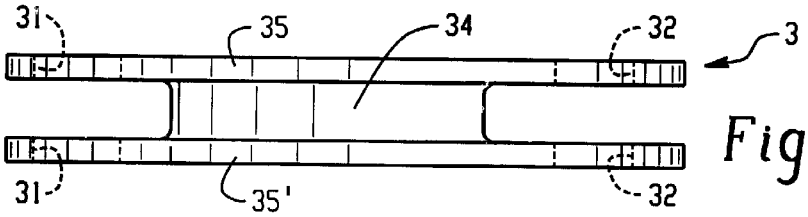

The inner rocker arm 3 (see FIG. 3) is formed by two parallel lateral walls 35, 35', joined together by a central bottom piece 34, an upper profile 36 of the walls 35, 35' being concave. The inner rocker arm 3 has, at one of its ends, a seat (bore) 31 for the transverse connector pin 37, the pin 37 comprising the contact surface with the valve stem V. At the other end of the inner rocker arm 3 is an opening 32 to accommodate a bushing 33, defining a bore 38, within which the parts of the compound pin 8 can easily slide, the function of which shall be described afterwards.

Figure 2A:
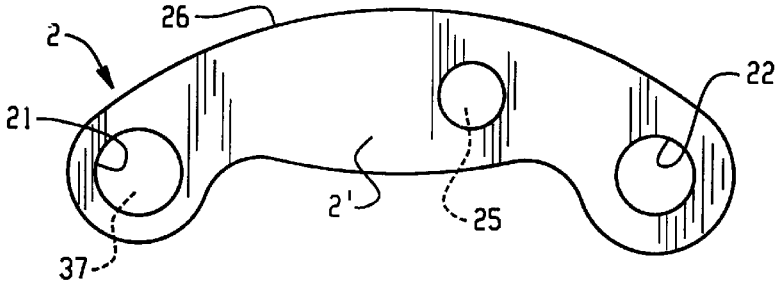
FIGS. 2A and 2B show one of the two cheeks or lateral plates comprising the outer rocker arm, in elevated and plan view, respectively.
Figure 2B:
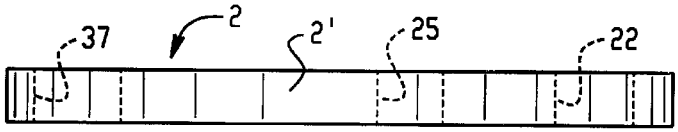
Figure 14A:
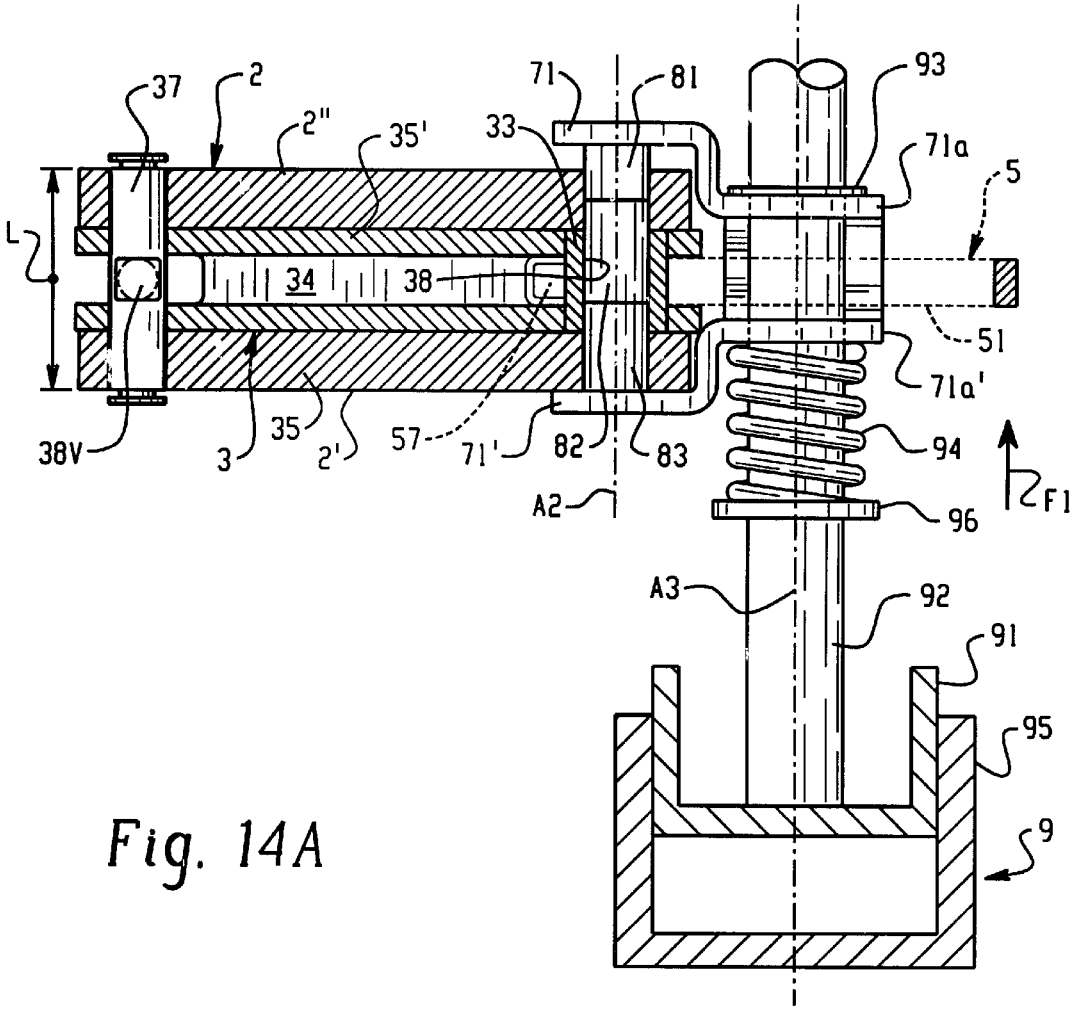
FIG. 14A shows, somewhat schematically, in top plan view, a feature of the device of the invention in order to illustrate the position of the actuator for the mutual linking of the inner and outer rocker arm.

The outer rocker arm 2 is formed by two cheeks or plates 2', 2" (see FIG. 2), the inner surface of each of which is placed against the lateral walls 35, 35' of the inner rocker arm 3 (see also FIG. 14A). The plates 2', 2" have upper surfaces 26 which are convex, the two plates 2', 2" of the outer rocker arm 2 having at one of their ends a seat (bore) 21 for the connector pin 37 of the two rocker arms and, having at the other end, a seat (bore) 22 for the compound pin 8.

Figure 4A:
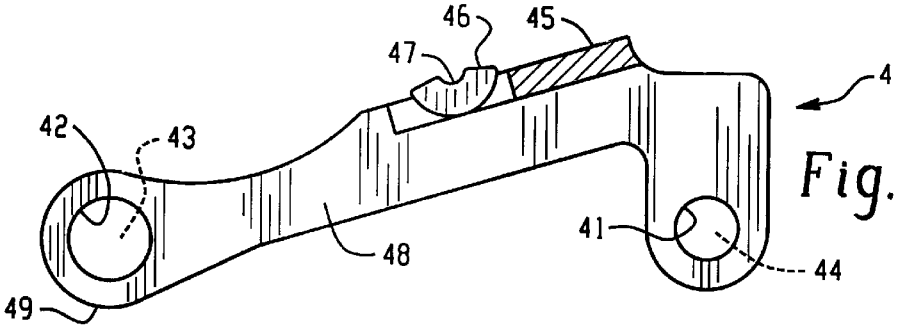
FIGS. 4A and 4B show the L-shaped lever carrying the roller, in elevated and plan view, respectively.
Figure 4B:
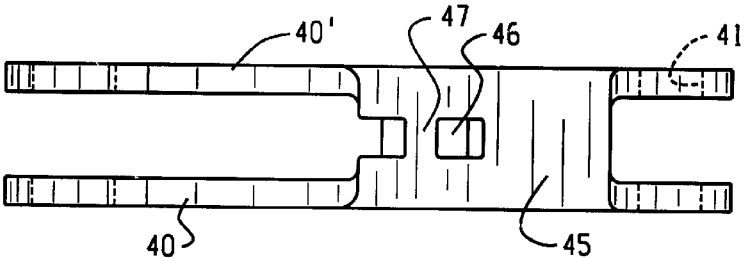
Figure 13:
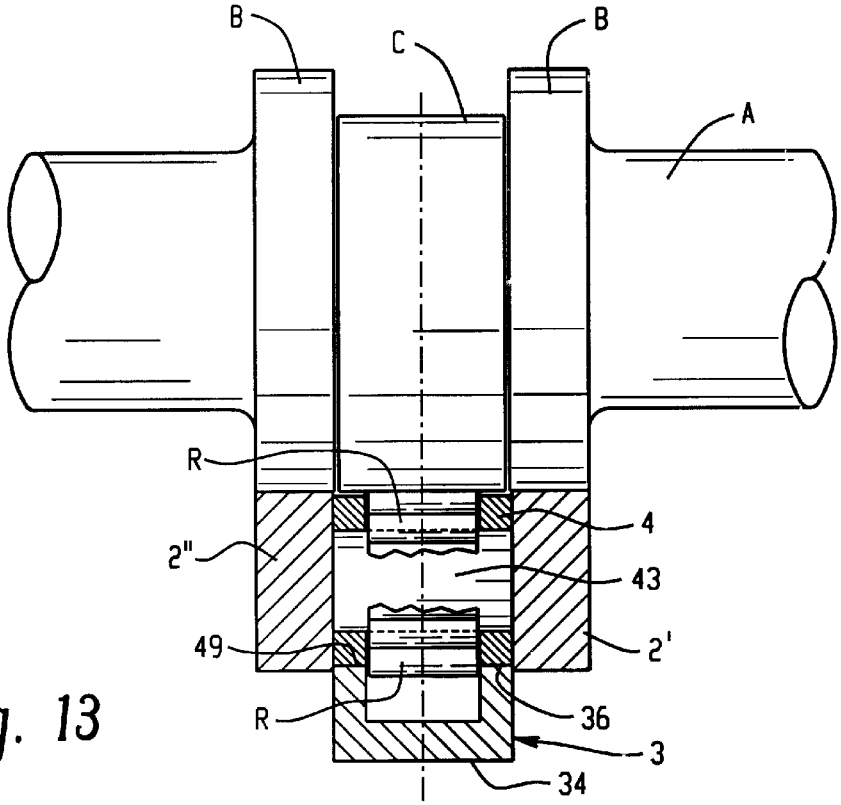
FIG. 13 shows the device of FIG. 1, sectioned along line XIII—XIII.

The L-shaped lever, designated as 4 (see FIG. 4), has a cross-section of an inverted U, with two walls 40, 40' joined together by an upper plate 45 from which is made, such as by a punch operation, a bracket 46 and a seat 47 for purposes to be indicated. The L-shaped lever 4 has, at the end of a longer branch 48, a seat (bore) 42 for an axle 43 of a roller (cam engagement member) R and, at the end of a shorter branch, a seat (bore) 41 for an oscillating pin 44. The branch 48 has a lower cylindrical end 49 supported against the concave surfaces 36 of the inner rocker arm 3, as is best seen in FIG. 13.

Figure 7A:
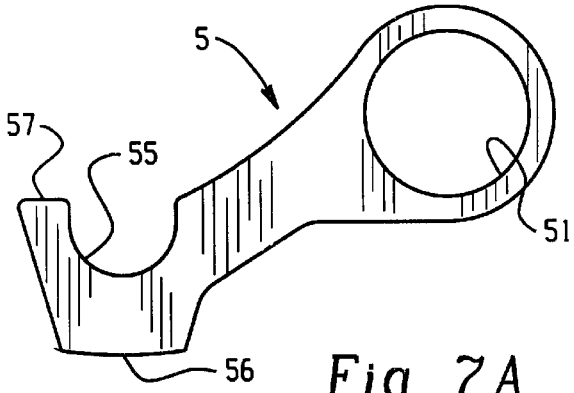
FIGS. 7A and 7B show, respectively in lateral elevated and plan view, the auxiliary arm which guides the pin for the oscillation of the rocker arms at one end, and at the other end forms an eccentric seat for the pivot pin of the L-shaped lever of FIG. 4.
Figure 7B:
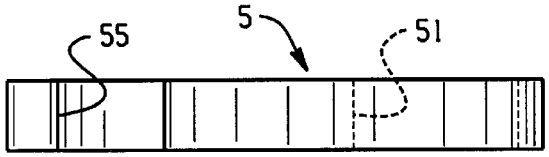

The auxiliary element 5, shown best in FIGS. 7A and 7B, is mounted in alignment with the lengthwise center line of the inner rocker arm 3 (see FIG. 14A), and comprises at one end a circular hole 51 which supports a pin 52 (shown only in FIG. 1), the pin 52 being better understood by reference to the above-incorporated Italian application. The pin 52 has an eccentric notch 54, within which is guided an oscillating pin 44 of the above-described L-shaped lever 4. The auxiliary element 5 terminates at the opposite end with a semicircular seat 55, which is bounded by an outside shoulder 57, for holding the bushing 33 (see FIGS. 14A and 14B) of the compound oscillating pin 8 of the two rocker arms. The auxiliary element 5 has at the bottom, with respect to the seat 55, a support surface 56 against a tappet (hydraulic lash adjuster) P. The semicircular seat 55 has a diameter equal to that of the bushing 33, so that the bushing 33 can be disposed in the bore 32 of the inner rocker arm 3;

It will become apparent to those skilled in the art that the use of the auxiliary arm 5 and rotatable pin 52 and eccentric notch 54 is by way of example only, and within the scope of the present invention, any number of other types of actuator could be utilized instead. All that is essential to the invention is that there be provided some form of actuator which can serve the intended purpose of moving the L-shaped lever 4 member laterally (i.e., transversely in the plane of FIG. 1), for reasons which will be described in greater detail subsequently. For purposes of subsequent description, the rotational position of the pin 52 will vary in accordance with engine speed. However, the invention is not so limited, and within the scope of the invention, the movement of the actuator for the lever member 4 could be manually selectable, or could vary in response to variations in any combination of vehicle and/or engine parameters.

Figure 5A:
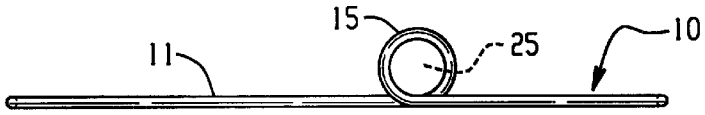
FIGS. 5A and 5B show, in elevated and plan view respectively, the auxiliary spring which keeps the outer rocker arm in contact with the cams.
Figure 5B:
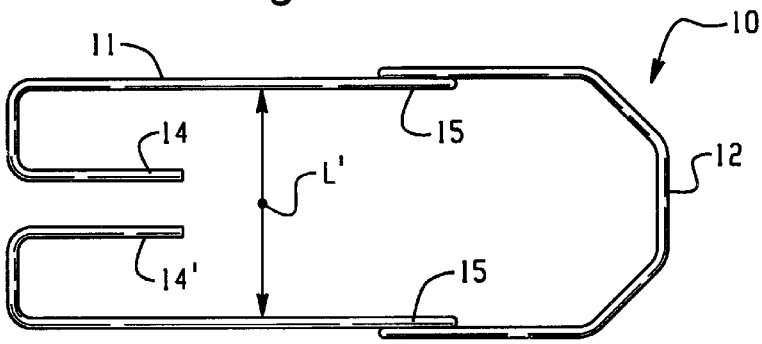
Figure 6:
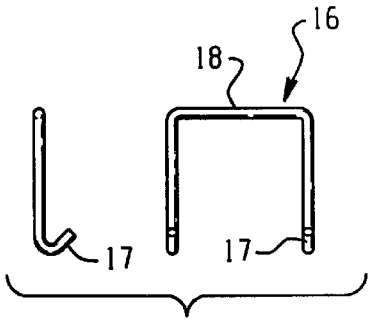
FIG. 6 shows a brace for the auxiliary spring of FIG. 5.
Figure 9:
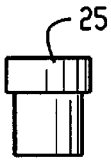
FIG. 9 shows the locking pin, on the cheeks of the outer rocker arm, for the auxiliary spring represented in FIG. 5.

The elastic element 10 (see FIGS. 5A, 5B), is formed by a single spring steel wire 11, having an essentially rectangular shape in plan view, with a width L' greater than the width L of the assembled rocker arms (FIG. 14A). As a result, the element 10 can be wedged on the outside of the cheeks 2', 2", being joined by a pair of eyelets 15, formed in the elastic element 10, to the bolts 25 (FIG. 9) which are secured to the cheeks 2' and 2", (see FIG. 2A in which the bores for the bolts 25 also bear the reference numerals "25"). The elastic element 10 has at one end a continuous segment 12, while at the opposite end it has two free branches 14, 14', bent inwardly to rest against the top of the connector pin 37 (see FIG. 1) of the two rocker arms. The elastic element 10 is elastically held in a state of tension by a U-clip 16 (see also FIG. 6) with ends bent in hook shape 17, able to be connected to the segment 12 of the elastic element 10, the cross piece 18 of the clip 16 being capable of insertion in the seat 47 of the bracket 46 of the L-shaped lever 4. The element 10 and the clip 16 are included for the purpose of maintaining the cheeks 2', 2" of the outer rocker arm 2 in contact with the pair of cams B (see FIG. 13).

Figure 8:
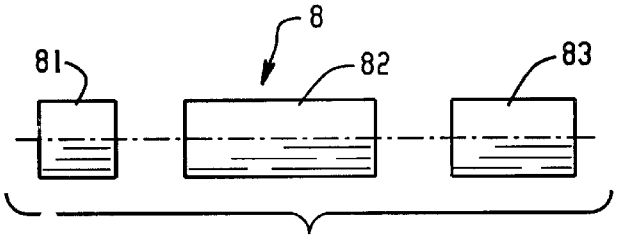
FIG. 8 shows the compound pin for controlling the latching of the rocker arms.
Figure 14B:
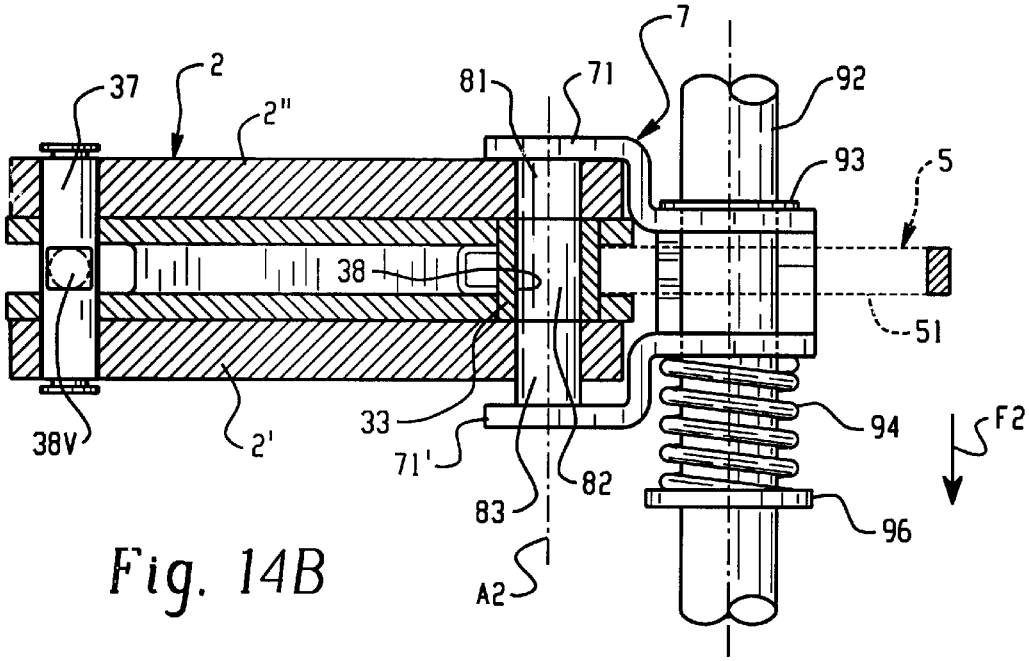
FIG. 14B shows, somewhat schematically, the position of the actuator for disconnecting the inner rocker arm from the outer one.

The compound pin 8 (see FIG. 8), comprises three generally cylindrical parts 81, 82, 83, of which the shortest part 81 has a length equal to the transverse thickness of the plate 2" of the outer rocker arm 2 (see FIG. 14B). The part 82 has a length equal to the width of the inner rocker arm 3 and of the bushing 33 (again see FIG. 14B), while the part 83 has a length around 50% greater than that of the shortest part 81. The pin parts 81, 82, and 83 have a diameter slightly less than that of the seats 22 of the cheeks 2' and 2" and slightly less than the internal diameter of the bore 38 of the bushing 33, which can be mounted within the seat 32 of the inner rocker arm 3.

However, those skilled in the art will understand that various other latching arrangements can be utilized, within the scope of the present invention. All that is essential to the invention is that there be provided some sort of selectable latching arrangement which can be shifted between two different conditions: one in which the right ends of the inner 3 and outer 2 rocker arms are latched together (FIG. 14A) and another in which the right ends of the inner and outer rocker arms are unlatched such that the rocker arms can oscillate or pivot relative to each other, about the common shaft or connector pin 37.

Figure 10:
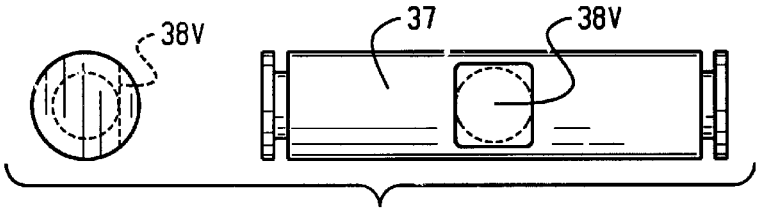
FIG. 10 shows the common shaft of the rocker arms, forming the shoe of the device.

The connector pin 37 (see FIG. 10) is secured in the aligned openings 31 of the inner rocker arm 3 and in the openings 21 of the cheeks 2' and 2", which are placed against the walls 35 and 35' of the inner rocker arm 3. In accordance with an important feature of the present invention, the pin 37 connects the two rocker arms 2 and 3 for either a common action ("latched") or a separate action ("unlatched") of these arms on the engine poppet valve V as described above. The connector pin 37 is orientable within the aligned holes 31 and 21 so that a flattened middle part 38V always rests against the head of the poppet valve V.

Figure 11:
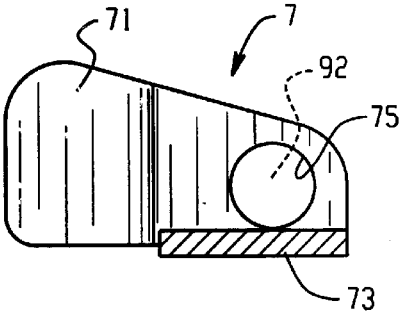
FIG. 11 shows, in median lengthwise section, the fork for shifting the actuator to modify the timing.
Figure 12:
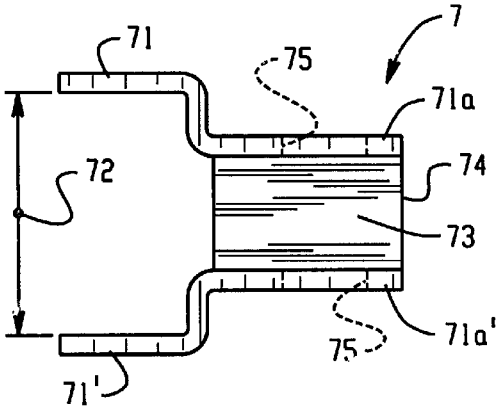
FIG. 12 shows, in plan view, the fork for shifting the actuator to modify the timing.

The fork element 7 (see FIGS. 11 and 12) has two bent branches 71, 71' with an internal spacing 72 slightly greater than the total of the lengths of the three cylindrical parts 81, 82, 83 of the compound pin 8, one next to the other. The branches 71, 71' form walls 71*a* and 71*a'* that approach each other and are joined together by means of a lower connection bridge 73, forming with them a U-shaped body 74, the branches 71*a* and 71*a'* having corresponding holes 75 for insertion of a shaft 92 of the actuator 9.

The actuator 9 (see FIG. 14A) is operated by an oil-dynamic (hydraulic) piston 91 or, alternatively, by electrical means, or any other suitable means, the particular design of the actuator 9 not comprising an essential feature of the invention. The piston 9 has a shaft (output) 92 which is guided by the piston 91, the piston 91 being disposed within a cylinder 95 which may preferably be designed for the possibility of a fairly short translation (piston stroke). The fork 7 is disposed on the shaft 92 in a position normally abutting against a locking washer 93, as a result of the force of a biasing spring 94 acting against the branch 71*a'* of the fork 7 and seated against the washer 96, which is fixed relative to the shaft 92.

Supplementing the above description with regard to the actuator 9 and the mounting of its components, FIG. 13 shows the positioning of the distributing shaft A and of the respective cams B and C with regard to the functioning of the device according to the invention. The central cam C acts on the roller R arranged at the end of the L-shaped lever 4. The impulse of the cam C is transmitted to the axle 43 of the roller and to the body of the lever 4, which rests by its cylindrical end 49 against the concave surfaces 36 of the inner rocker arm 3.

Accordingly, the cam C acts on the inner rocker arm 3 ("low lift"), while the outer rocker arm 2 comprising the cheeks 2', 2" is actuated by the outside cams B directly against the convex surfaces 26 of the cheeks themselves. When the cams B, having a greater eccentricity, press against the outer rocker arm 2, connected to the inner rocker arm 3 by the connector pin 37, the cam C is thereby rendered ineffective.

The action of the cams B, with greater eccentricity, therefore produces a greater valve lift of the engine poppet valve V ("high lift"), an earlier opening and a later closing, and this in response to higher engine speed. When the inner rocker arm 3 is being controlled by the cam C, to accomplish low lift, the specific amount of lift can be varied as a function of a vehicle or engine parameter, such as speed. This further variation of lift is controlled by means of the actuator 9, as shall be explained below.

FIGS. 14A and 14B illustrate the action of the actuator 9. At relatively higher engine speeds, and as shown in FIG. 14A, the fork 7, by means of the piston 91, is displaced along the direction of the arrow F1 and the branch 71' abuts against the cheek 2' of the outer rocker arm 2. The part 83 of the pin 8, securing the cheek 2', enters the bushing 33, pushing the central part 82 of the pin 8 through it, along an axis A2, and the part 81 of same secures the cheek 2', so that both the rocker arms are joined ("latched"). The assemblage of the two rocker arms is thus controlled only by the outside cams B ("high lift") and the cam C is ineffective. See the graph labeled "B" in FIG. 15, which represents the fixed, high lift valve operation, it being understood that the term "fixed" simply means that with the valve control system of the invention in the condition shown in FIG. 14A, the relationship of valve lift to cam (distributing) shaft A rotational angle is fixed, or constant.

At relatively lower engine speeds, the piston 91 is retracted, along its axis A3 (see FIG. 14A) as in FIG. 14B, pulling the fork 7 in the direction of arrow F2, and therefore only the inner rocker arm 3 operates, because the two cheeks 2', 2" of the outer rocker arm 2 are idle on the compound pin 8. In this fashion, the inner rocker arm 3 is unlatched and can oscillate about the bushing 33, which is always supported by the semicircular seat 55 of the auxiliary element 5, the tip 57 of whose outside shoulder is shown in FIG. 14A.

In accordance with an important aspect of the invention, the valve control system illustrated and described herein provides both dual lift capability, in response to the rocker arms being either latched (FIG. 14A) or unlatched (FIG. 14B), and also VRRS (variable ratio rocker system) capability, in response to rotation of the eccentric pin 52. More specifically, and as merely one example of the use of the present invention, whenever the system is operating in the low lift mode of FIG. 14B, the pin 52 is initially in the position shown in FIG. 1. The described position of the pin 52 corresponds, by way of example only, to a minimum speed condition, in which the roller R is disposed at the far left end of its travel in FIG. 1, which represents the minimum lift (see graph C1 in FIG. 15, "Min. low lift") of the poppet valve V. As the engine speed gradually increases, the pin 52 rotates clockwise from the position shown in FIG. 1, thus moving the L-shaped lever 4 to the right in FIG. 1, and also moving the roller R to the right. As the roller R moves to the right in FIG. 1, the effective point of contact of the low lift cam C and the inner rocker arm 3 moves to the right, gradually increasing the lift, even while in the low lift mode, until the lift eventually reaches that represented by the graph C2 in FIG. 15, ("Max. low lift").

Figure 15:
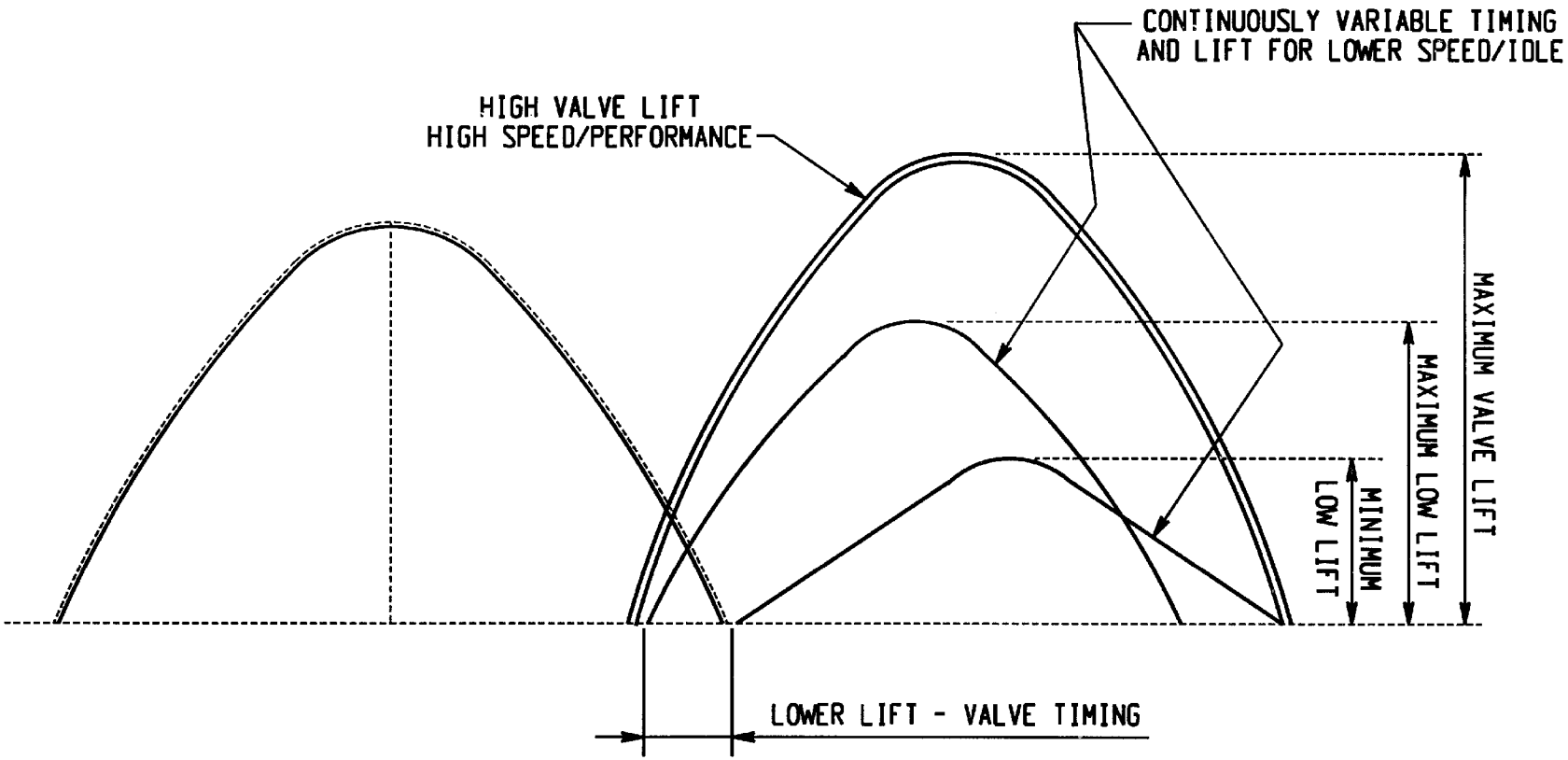
FIG. 15 is a graph of the various valve lift versus camshaft rotation angle relationships, as well as the variations in timing in the low lift mode, which can be achieved by the present invention.

As the roller R moves to the right in FIG. 1, and the point of contact between the cam C and the inner rocker arm 3 moves to the right, there is another result. Moving the contact point to the right, with the camshaft A rotating clockwise as seen in FIG. 1, is the same as "advancing" the valve actuation, because the cam C engages the contact point sooner. Thus, in progressing from the Min. low lift C1 to the Max. low lift C2, the timing of the initial valve opening advances, as is shown in FIG. 15 ("Low lift-valve timing"). Therefore, the present invention makes it possible to switch between a fixed, high lift mode of operation and a variable, phase-shifted, low lift mode of operation.

Once the engine speed reaches a certain, predetermined level, the actuator 9 moves to the latched condition of FIG. 14A, and thereafter, the system operates in the high lift mode (graph "B" in FIG. 15), with the amount of lift remaining constant, during which the position of the lever 4 and roller R is irrelevant to the amount of lift.

It should be noted that the present invention is illustrated in the drawings as comprising a series of parts which, in some cases, could probably be combined with each other, or formed integrally with the cylinder head, or in some other manner redesigned to reduce the total number of parts. However, the objective of showing the version of the present invention being shown herein is partly to illustrate the various functions which should preferably be performed by various parts of the entire valve control assembly, and those skilled in the art will understand that the invention is not limited to the particular parts being separate as shown.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve control system for an internal combustion engine of the type including a cylinder head, an engine poppet valve, and a valve actuating camshaft defining a cam axis having a first cam and a second cam; said valve control system comprising a first rocker arm disposed for operable engagement with said first cam; a second rocker arm disposed for operable engagement with said second cam; and means having a first condition for selectively interconnecting said first and second rocker arms for pivotal movement in unison in response to a force applied by said first cam to said first rocker arm; said means for selectively interconnecting having a second condition in which said first and second rocker arms have pivotal movement relative to each other; characterized by:

(a) each of said first and said second rocker arms having a valve end disposed adjacent said engine poppet valve;

(b) a connector operably associated with said valve ends of said rocker arms whereby the only relative movement permitted between said first and second rocker arms is said relative pivotal movement, said relative pivotal movement being about said connector, said relative pivotal movement occurring only when said means for selectively interconnecting said rocker arms is in said second condition;

(c) one of said second rocker arm and said connector being configured for engagement with said engine poppet valve; and (d) each of said first and second rocker arms having a latching end disposed at the axially opposite end from said valve ends, said means for selectively interconnecting said rocker arms being operably associated with said latching ends of said rocker arms.

2. A valve control system as claimed in claim 1, characterized by said latching end of said first rocker arm defining a first latch bore and said latching end of said second rocker arm defining a second latch bore, said latch bores being coaxial with each other when said means for selectively interconnecting said rocker arms is in said first condition, said latch bores defining an axis substantially parallel to said cam axis.

3. A valve control system as claimed in claim 2, characterized by said means for selectively interconnecting said rocker arms comprises a latch member axially moveable within said first and second latch ores between said first condition in which said latch member is disposed within both of said latch bores and said second condition in which said latch member is disposed within only said second latch bore.

4. A valve control system as claimed in claim 3, characterized by said means for selectively interconnecting said rocker arms includes an actuator assembly defining an axis, said axis being substantially parallel to said cam axis, said actuator assembly including an output member axially moveable along said axis between first and second, to move said latch member between said first condition and said second condition, respectively.

5. A valve control system as claimed in claim 3, characterized by said latch member being wholly disposed within said latching bores, as said latch member moves between said first condition and said second condition, whereby said latch member is not exposed outside of said rocker arms.

6. A valve control system as claimed in claim 1, characterized by said second rocker arm defining an upper concave surface, and said cam engagement member comprising a roller in engagement with both said second cam and said concave surface.

7. A valve control system for an internal combustion engine of the type including a cylinder head, an engine poppet valve, and a valve actuating camshaft defining a cam axis having a first cam and a second cam; said valve control system comprising a first rocker arm disposed for operable engagement with said first cam; a second rocker arm disposed for operable engagement with said second cam; and means having a first condition for selectively interconnecting said first and second rocker arms for pivotal movement in unison in response to a force applied by said first cam to said first rocker arm; said means for selectively interconnecting having a second condition in which said first and second rocker arms have pivotal movement relative to each other; characterized by:

(a) each of said first and said second rocker arms having a valve end disposed adjacent said engine poppet valve;

(b) a connector operably associated with said valve ends of said rocker arms whereby the only relative movement permitted between said first and second rocker arms is said relative pivotal movement, said relative pivotal movement being about said connector; and (c) a cam engagement member in operable engagement with said second cam and with said second rocker arm, and means operable to vary the lateral location of said cam engagement member, relative to said valve end of said second rocker arm, and the resulting valve lift, while said means for selectively interconnecting is in said second condition.

8. A valve control system as claimed in claim 7, characterized by each of said first and second rocker arms having a latching end disposed at the axially opposite end from said valve ends, said means for selectively interconnecting said rocker arms being operably associated with said latching ends of said rocker arms, and said cam engagement member being disposed intermediate said valve ends and said latching ends.

9. A valve control system for an internal combustion engine of the type including a cylinder head, an engine poppet valve, and a valve actuating camshaft defining a cam axis having a first cam and a second cam; said valve control system comprising a first rocker arm disposed for operable engagement with said first cam; a second rocker arm disposed for operable engagement with said second cam; latch means having a first condition for selectively interconnecting said first and second rocker arms for pivotal movement in unison in response to said operable engagement of said first cam and said first rocker arm to provide a first, fixed relationship of valve opening versus rotational displacement of said camshaft; said latch means for selectively interconnecting having a second condition in which said first and second rocker arms have pivotal movement relative to each other; characterized by:

(a) a cam engagement member in operable engagement with, and disposed between, said second cam and said second rocker arm;

(b) said cam engagement member being fixed for movement with a laterally moveable lever member;

(c) an actuator operable to vary the lateral location of said lever member and said cam engagement member while said means for selectively interconnecting is in said second condition;

(d) whereby the valve control system is operable to provide, in said second condition, a series of second, phase-shifted relationships of valve opening versus rotational displacement of said camshaft.

10. A valve control system as claimed in claim 9, characterized by said first cam and said first rocker arm being configured such that said first, fixed relationship of valve opening versus rotational displacement of said camshaft has a substantially greater amplitude than any of said series of second, phase-shifted relationships.

11. A valve control system as claimed in claim 9, characterized by said lever member and said cam engagement member being located, relative to said cam axis and said second rocker arm such that said series of second, phase-shifted relationships of valve opening versus rotational displacement of said camshaft is disposed entirely within said first, fixed relationship.

12. A valve control system as claimed in claim 9, characterized by said actuator operable to vary the lateral location of said lever member comprises a rotatable member and an eccentric connection of said lever member to said rotatable member.

* * * * *